US009933731B2

(12) United States Patent
Kimura et al.

(10) Patent No.: US 9,933,731 B2
(45) Date of Patent: Apr. 3, 2018

(54) TEMPERATURE DETECTION FOR A FIXING SYSTEM OF AN IMAGE FORMING APPARATUS

(71) Applicant: FUJI XEROX CO., LTD., Tokyo (JP)

(72) Inventors: Kouichi Kimura, Kanagawa (JP); Toshinori Sasaki, Kanagawa (JP); Mizuki Sugino, Kanagawa (JP); Mitsutoshi Hongo, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/249,523

(22) Filed: Aug. 29, 2016

(65) Prior Publication Data

US 2017/0255140 A1 Sep. 7, 2017

(30) Foreign Application Priority Data

Mar. 4, 2016 (JP) ..... 2016-041779

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
USPC ..... 399/69, 320
See application file for complete search history.

(56) References Cited

U.S. PATENT DOCUMENTS 5,689,789 A * 11/1997 Moser ..... G03G 15/2053 219/216
5,983,048 A * 11/1999 Moser ..... G03G 15/2039 399/320
2011/0103809 A1* 5/2011 Kuwata ..... G03G 15/234 399/16

FOREIGN PATENT DOCUMENTS

JP 96179 A 1/1997
JP 2003107810 A 4/2003
JP 2005137983 A * 6/2005
JP 2008-129123 A 6/2008

OTHER PUBLICATIONS

Communication dated Aug. 9, 2016, from the Japanese Patent Office in counterpart application No. 2016-041779.

* cited by examiner

*Primary Examiner* — Quana M Grainger
(74) *Attorney, Agent, or Firm* — Sughrue Mion, PLLC

(57) ABSTRACT

An image forming apparatus includes a heating unit that heats a recording material, a contact member that is positioned upstream or downstream from the heating unit in a transport direction of the recording material and is in contact with the recording material, the contact member being configured in such a manner that a portion of the contact member that is in contact with the recording material moves with the recording material, a temperature detection unit that detects a temperature of the contact member, and a control unit that controls, based on a detection result obtained by the temperature detection unit, an output of the heating unit.

12 Claims, 5 Drawing Sheets

TEMPERATURE DETECTION FOR A FIXING SYSTEM OF AN IMAGE FORMING APPARATUS

CROSS-REFERENCE TO RELATED APPLICATIONS

This application is based on and claims priority under 35 USC 119 from Japanese Patent Application No. 2016-041779 filed Mar. 4, 2016.

BACKGROUND (i) Technical Field

The present invention relates to an image forming apparatus.

(ii) Related Art

If the temperature of a recording material is detected, and heat is applied to the recording material on the basis of the detection results, for example, the temperature of the recording material may be brought closer to a predetermined temperature.

For example, the temperature of the recording material may be detected by using a non-contact sensor. However, in the case where the recording material is transparent, it is difficult to detect the temperature of the recording material. In this case, the temperature of the recording material may be detected by using a contact sensor. However, in the case of using a contact sensor, scratches are likely to be formed on the recording material.

SUMMARY

According to an aspect of the invention, there is provided an image forming apparatus including a heating unit that heats a recording material, a contact member that is positioned upstream or downstream from the heating unit in a transport direction of the recording material and is in contact with the recording material, the contact member being configured in such a manner that a portion of the contact member that is in contact with the recording material moves with the recording material, a temperature detection unit that detects a temperature of the contact member, and a control unit that controls, based on a detection result obtained by the temperature detection unit, an output of the heating unit.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described in detail below with reference to the accompanying drawings.

Figure 1:
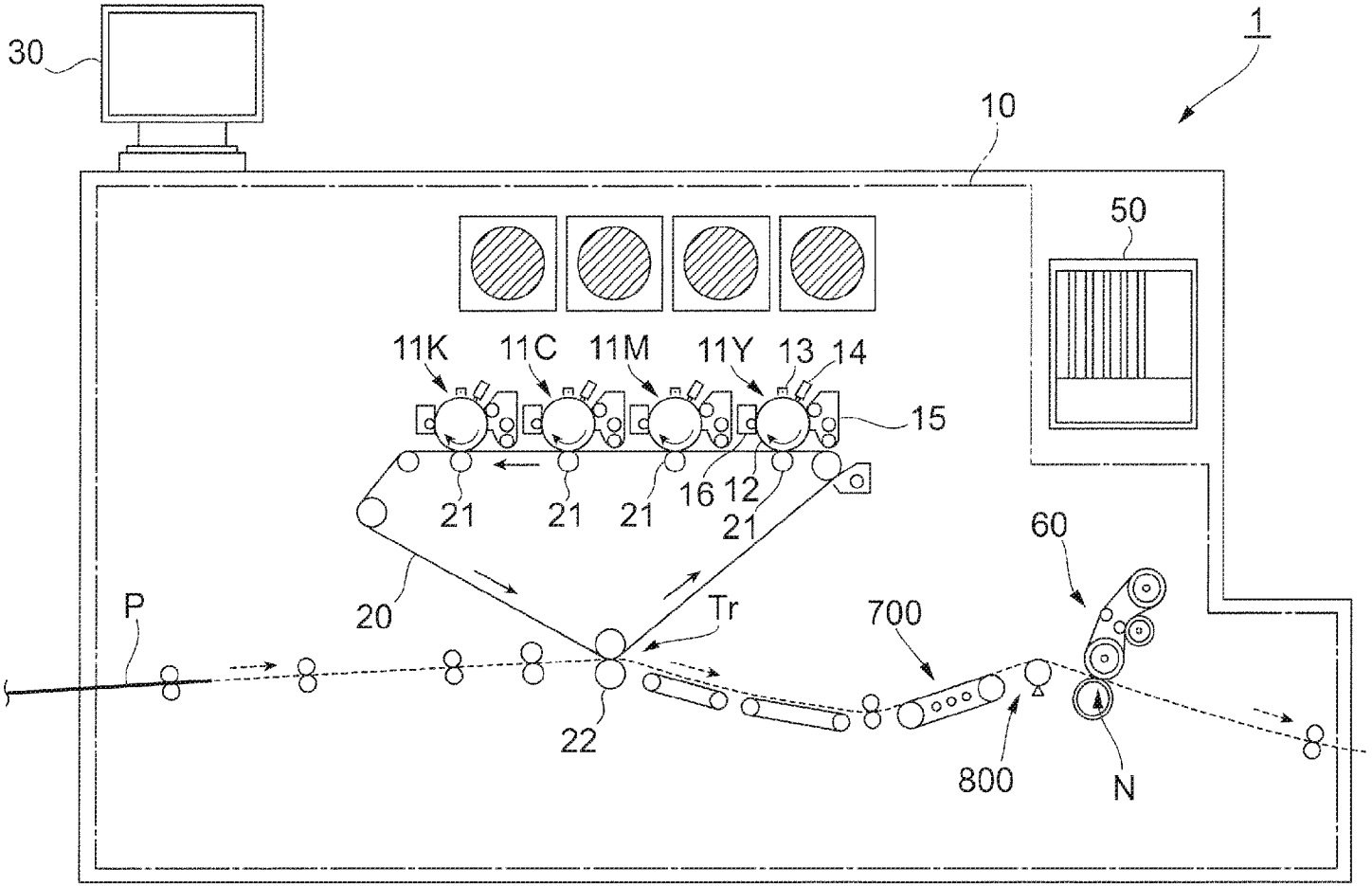
FIG. 1 is a diagram illustrating an exemplary configuration of an image forming apparatus according to an exemplary embodiment of the present invention.

FIG. 1 is a diagram illustrating an exemplary configuration of an image forming apparatus 1 according to an exemplary embodiment of the present invention.

The image forming apparatus 1 illustrated in FIG. 1 is a so-called tandem-type color printer and includes an image forming unit 10 that performs image formation on the basis of image data. The image forming apparatus 1 further includes a controller 50.

The controller 50, which is an example of a control unit, includes a program-controlled central processing unit (CPU) and controls the operations of each device and each functional unit that are included in the image forming apparatus 1. In addition, the controller 50 performs communication with a personal computer and the like, performs processing on image data, and the like.

Furthermore, the image forming apparatus 1 is provided with a user interface unit 30, which receives an operation input from a user and performs display of various information items to a user.

The image forming unit 10, which is an example of an image forming unit, is a functional unit that employs, for example, an electrophotographic system and forms an image. The image forming unit 10 includes four image forming units, which are an image forming unit 11Y that corresponds to yellow (Y), an image forming unit 11M that corresponds to magenta (M), an image forming unit 11C that corresponds to cyan (C), and an image forming unit 11K that corresponds to black (K).

Note that, in the following description, when there is no need to distinguish particular image forming units from each other, the image forming units will be referred to as image forming units 11.

The image forming units 11, which are the image forming unit 11Y, the image forming unit 11M, the image forming unit 11C, and the image forming unit 11K, respectively form toner images of yellow, magenta, cyan, and black.

Each of the image forming units 11 includes a photoconductor drum 12 on which a toner image of the corresponding color is to be formed after an electrostatic latent image has been formed on the photoconductor drum 12.

In addition, each of the image forming units 11 includes a charger 13 that charges a surface of the corresponding photoconductor drum 12 and an exposure unit 14 that exposes the photoconductor drum 12, which has been charged by the charger 13, to light on the basis of image data.

Furthermore, each of the image forming units 11 includes a developing unit 15 that develops, with the corresponding color toner, an electrostatic latent image formed on the corresponding photoconductor drum 12 and a cleaner 16 that cleans the surface of the photoconductor drum 12 after a toner image of the corresponding color has been transferred.

Note that the configurations of the image forming units 11 are similar to one another except with regard to the toners contained in the developing units 15.

The image forming unit 10 includes an intermediate transfer belt 20 onto which toner images of the different colors, which have been formed on the photoconductor drums 12 of the image forming units 11, are transferred and first transfer rollers 21 that transfer (in a first transfer process) the toner images of the different colors formed by the image forming units 11 onto the intermediate transfer belt 20.

In addition, the image forming unit 10 includes a second transfer roller 22 that collectively transfers (in a second transfer process) the toner images of the different colors, which have been transferred to the intermediate transfer belt 20 in such a manner as to be superposed with one another, onto a recording material P.

Furthermore, the image forming unit 10 includes a fixing device 60 that fixes the toner images of the different colors, which have been transferred in the second transfer process to the recording material P, onto the recording material P.

Note that, in the present exemplary embodiment, a region in which the second transfer roller 22 is disposed and in which toner images of the different colors on the intermediate transfer belt 20 are transferred in the second transfer process onto the recording material P will hereinafter be referred to as a second transfer region Tr.

Examples of the recording material P include a sheet of paper, a resin sheet, and a resin film.

Note that, in the present exemplary embodiment, a case where an image is formed on the recording material P that is a continuous recording material (recording material having a continuous form) extending in a transport direction of the recording material P and that is not cut into individual recording material pieces, the recording material P being made of a resin material and being transparent, is described as an example.

Operation of the image forming apparatus 1 will now be described.

When an image forming operation is performed, the image forming units 11 respectively form toner images of black, cyan, magenta, and yellow through an electrophotographic process.

The toner images of the different colors, which have been formed by the corresponding image forming units 11, are sequentially transferred in the first transfer process onto the intermediate transfer belt 20 by the corresponding first transfer rollers 21, and a superposed toner image that is formed of the toner images of the different colors, which are superposed with one another, is formed on the intermediate transfer belt 20.

The toner images on the intermediate transfer belt 20 is transported to the second transfer region Tr, in which the second transfer roller 22 is disposed, along with movement of the intermediate transfer belt 20.

In a recording-material transport system, the recording material P is sent by a feed roller (not illustrated) around which the recording material P is wound, and the recording material P is transported along a predetermined transport path so as to reach the second transfer region Tr. In the second transfer region Tr, toner images on the intermediate transfer belt 20 are collectively transferred in the second transfer process onto the recording material P by a transfer electric field formed by the second transfer roller 22.

After that, the recording material P to which the toner images have been transferred is separated from the intermediate transfer belt 20 and is transported toward the fixing device 60 along the transport path. The recording material P is heated by a heating device 700 in the process of being transported toward the fixing device 60, after which the recording material P reaches the fixing device 60 via a contact member 800.

In the fixing device 60, the recording material P is supplied to a nip part N of the fixing device 60.

As a result, heat and pressure are applied to the recording material P, and the toner images are fixed onto the recording material P. Then, the recording material P is wound up by a winding device (not illustrated).

Figure 2:
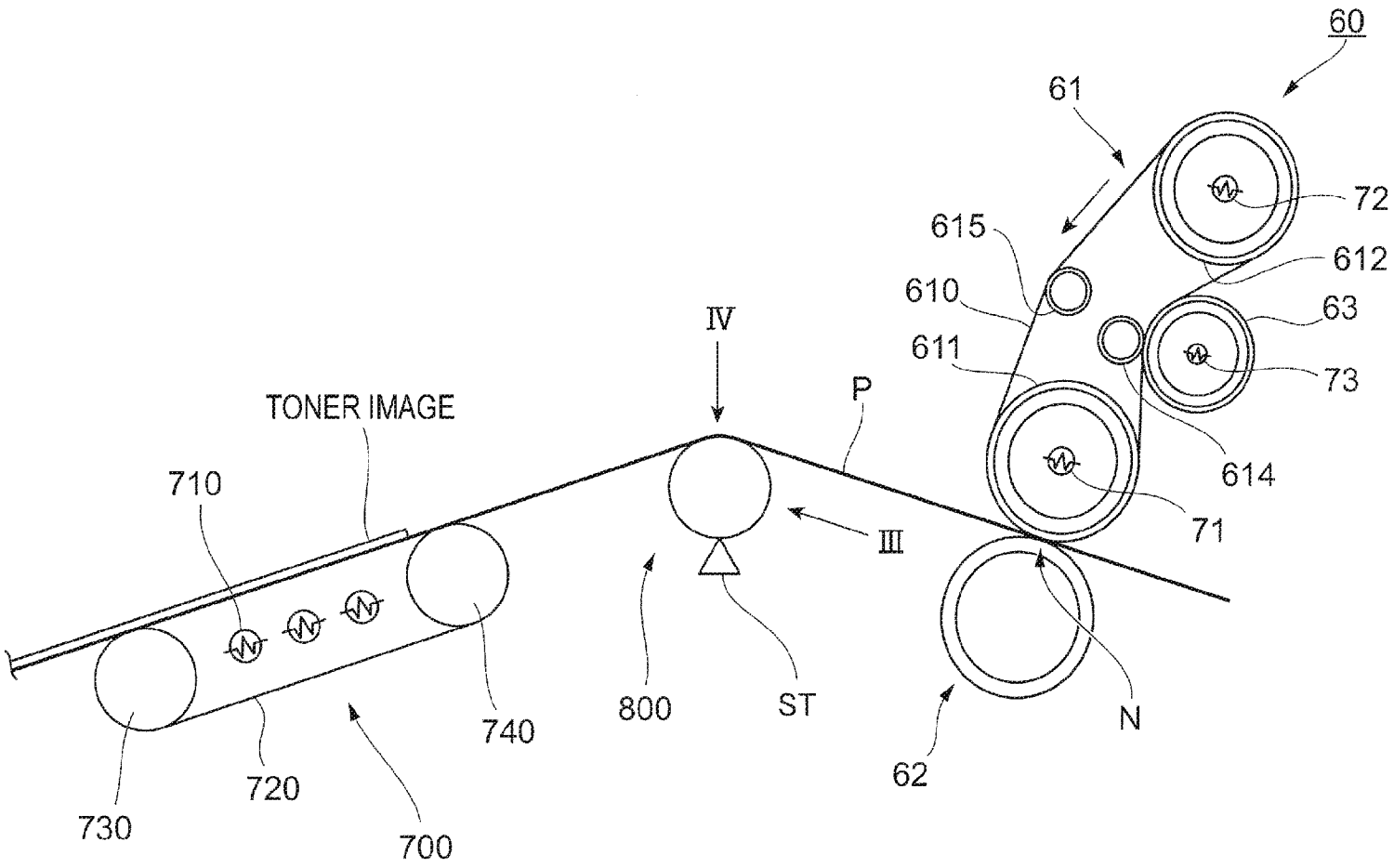
FIG. 2 is a diagram illustrating a heating device, a contact member, a temperature sensor, and a fixing device.

FIG. 2 is a diagram illustrating the heating device 700, the contact member 800, a temperature sensor ST, and the fixing device 60.

In the present exemplary embodiment, the heating device 700, which is an example of a heating unit that heats the recording material P, is disposed further downstream than the fixing device 60 in the transport direction of the recording material P.

In addition, in the transport direction of the recording material P, the contact member 800, which is in contact with the recording material P, and the temperature sensor ST, which is an example of a temperature detection unit that detects the temperature of the contact member 800, are disposed between the heating device 700 and the fixing device 60.

The heating device 700 applies heat to the recording material P, which is to be supplied to the fixing device 60, at a position upstream from the fixing device 60.

In order to apply heat to the recording material P by using only the fixing device 60, it is necessary to increase the output of the fixing device 60, and accordingly, the size of the fixing device 60 is likely to increase.

In the present exemplary embodiment, the nip part N is formed by causing a fixing roller 611 (details of this matter will be described later) and a pressure roller 62 to be pressed into contact with each other. The fixing roller 611 and the pressure roller 62 according to the present exemplary embodiment each have a roll-like shape, and accordingly, a contact area between the fixing roller 611 and the pressure roller 62 is small. In this case, the amount of heat that is to be applied to the recording material P is likely to decrease.

The fixing device 60 includes a fixing-belt module 61, which includes a fixing belt 610, and the pressure roller 62, which is pressed against the fixing-belt module 61. The fixing device 60 further includes an external heating roller 63 that heats the fixing belt 610 while stretching the fixing belt 610 from the outside.

In the present exemplary embodiment, the recording material P, on which toner images have been placed, is nipped between the fixing belt 610 and the pressure roller 62, and heat and pressure are applied to the recording material P so as to fix the toner images onto the recording material P.

The fixing-belt module 61 is provided with the fixing belt 610 that moves circularly and the fixing roller 611 that heats the fixing belt 610 from a space enclosed by the fixing belt 610.

The fixing roller 611 rotates in a counterclockwise direction in FIG. 2 while stretching the fixing belt 610. The fixing roller 611 is pressed toward the pressure roller 62 in the nip part N, which is a region in which the fixing-belt module 61 and the pressure roller 62 are pressed into contact with each other (are in contact with each other while being pressed against each other).

In addition, the fixing belt module 61 is provided with an internal heating roller 612 that heats the fixing belt 610. A counter roller 614 is disposed at a position downstream from the nip part N in such a manner as to face the external heating roller 63 with the fixing belt 610 interposed between the counter roller 614 and the external heating roller 63.

A stretching roller 615 that stretches the fixing belt 610 from the space enclosed by the fixing belt 610 is disposed at a position downstream from the internal heating roller 612 and upstream from the nip part N.

The fixing belt 610 has an endless loop shape.

The fixing roller 611 is a cylindrical roller. The fixing roller 611 rotates in the counterclockwise direction in FIG. 2 as a result of receiving a rotational driving force from a drive motor (not illustrated). The fixing roller 611 is heated to a predetermined temperature by a halogen heater 71, which is an example of a heating source and which is disposed in an area inside the fixing roller 611.

The internal heating roller 612 is a cylindrical roller. The internal heating roller 612 is heated to a predetermined temperature by a halogen heater 72, which is an example of a heating source and which is disposed in an area inside the internal heating roller 612.

The external heating roller 63 is a cylindrical roller. The external heating roller 63 is heated to a predetermined temperature by a halogen heater 73, which is an example of a heating source and which is disposed in an area inside the external heating roller 63.

The fixing device 60 according to the present exemplary embodiment employs a configuration in which the fixing belt 610 is heated by the fixing roller 611, the internal heating roller 612, and the external heating roller 63.

The pressure roller 62 is formed by stacking an elastic layer on a columnar roller, which serves as a base member, and stacking a release layer on the elastic layer.

The pressure roller 62 is driven by the fixing roller 611 and rotates in a clockwise direction in FIG. 2 along with rotation of the fixing roller 611 of the fixing belt module 61 in the counterclockwise direction.

The pressure roller 62 is pressed against the outer peripheral surface of the fixing belt 610 and applies pressure to the recording material P that is positioned between the fixing belt 610 and the pressure roller 62.

As an additional point, in the present exemplary embodiment, pressure and heat are applied to the recording material P on which toner images have been placed as a result of the recording material P being nipped between the fixing belt 610 and the pressure roller 62, and the toner images on the recording material P are fixed onto the recording material P.

The heating unit 700 applies heat to the recording material P, which passes above the heating unit 700 in FIG. 2, by coming into contact with the recording material P. In addition, the heating unit 700 applies heat to one of the two surfaces of the recording material P, the surface being opposite to the other surface of the recording material P on which the unfixed toner images have been formed. The heating device 700 includes heating sources 710 that are formed of halogen heaters and the like.

A member that is to be pressed against the recording material P is not provided at a position facing the heating unit 700 (above the heating unit 700 in FIG. 2), and in the present exemplary embodiment, the recording material P is heated by the heating unit 700 in a state where the recording material P is not sandwiched between such a member and the heating unit 700. In other words, in the present exemplary embodiment, the recording material P is heated by the heating unit 700 in a state where pressure is not applied to the recording material P.

The heating device 700 includes a transport belt 720 that transports the recording material P toward the fixing device 60. The transport belt 720 is formed in an endless loop shape (annular shape) and moves circularly in the clockwise direction in FIG. 2. In the present exemplary embodiment, the heating sources 710 are disposed in an area enclosed by the transport belt 720, which is formed in an endless loop shape. In addition, in the present exemplary embodiment, a support roller 730 and a driving roller 740 are disposed in the area enclosed by the transport belt 720. The support roller 730 supports the transport belt 720 from the space enclosed by the support roller 730, and the driving roller 740 causes the transport belt 720 to rotate.

In the present exemplary embodiment, the transport belt 720 is positioned between the heating sources 710 and the recording material P that is heated by the heating sources 710, and the recording material P is heated by the heating sources 710 via the transport belt 720.

Here, for example, in the case of a configuration in which the transport belt 720 is not provided and in which the recording material P is brought into contact directly with the heating sources 710, scratches are likely to be formed on the recording material P due to the fact that the recording material P and the heating sources 710 rub against each other. In the present exemplary embodiment, the recording material P is transparent, and accordingly, it is likely that scratches formed on the recording material P will be noticeable.

The contact member 800 is a member having a roll-like shape or a substantially roll-like shape that rotates while being in contact with the recording material P. More specifically, the contact member 800 is formed of a metal roller having a cylindrical shape.

In the present exemplary embodiment, rotation of the contact member 800 and transportation of the recording material P are performed in such a manner that a portion of the contact member 800 that is in contact with the recording material P (the outer circumferential surface of the contact member 800) moves with the recording material P.

In the present exemplary embodiment, rotation of the contact member 800 and transportation of the recording material P are performed in such a manner that the peripheral speed of the contact member 800 (the moving speed of the outer circumferential surface of the contact member 800) and the moving speed of the recording material P are equal to each other.

Here, the rotation of the contact member 800 may be performed by causing the contact member 800 to be driven by the movement of the recording material P. Alternatively, a driving source (not illustrated) that causes the contact member 800 to rotate may be provided so as to cause the contact member 800 to rotate by using the driving source.

In the present exemplary embodiment, the contact member 800 is in contact with one of the two surfaces of the recording material P, the surface not having an unfixed image (an unfixed toner image) formed thereon.

In the present exemplary embodiment, the contact member 800 is pressed against the recording material P, and the recording material P is partially wound around the contact member 800.

In the present exemplary embodiment, the temperature of the recording material P is detected by using the temperature sensor ST. The controller 50 (see FIG. 1), which is an example of a control unit, controls the heating device 700 (heating sources 710) on the basis of detection results obtained by the temperature sensor ST. More specifically, the controller 50 switches the heating sources 710 of the heating device 700 on and off and adjusts the output of the heating sources 710 in such a manner that the temperature detected by the temperature sensor ST is a predetermined temperature.

Here, in the present exemplary embodiment, the temperature of the recording material P is detected by detecting the temperature of the contact member 800 instead of directly detecting the temperature of the recording material P.

In the case of directly detecting the temperature of the recording material P, for example, it may be considered to bring the temperature sensor ST into direct contact with the recording material P. However, in this case, scratches are likely to be formed on the recording material P. In particular, in the case where the recording material P is transparent as in the present exemplary embodiment, it is likely that scratches formed on the recording material P will be noticeable.

In order to prevent scratches from being formed, it may be considered to employ a non-contact temperature sensor ST. However, in the case where the recording material P is transparent as in the present exemplary embodiment, it is difficult to detect the temperature of the recording material P by using such a non-contact temperature sensor ST.

Figure 3:
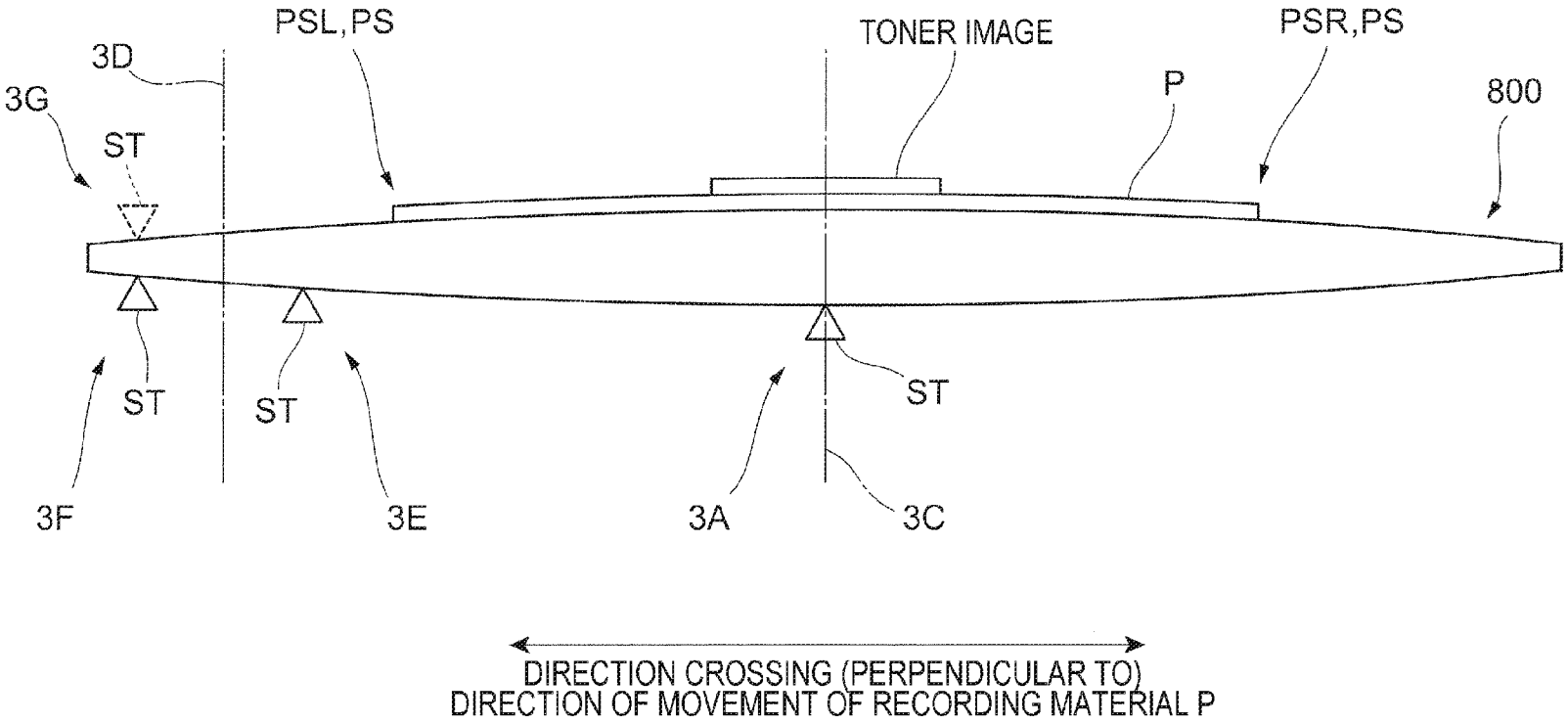
FIG. 3 is a diagram illustrating the contact member, the temperature sensor, and the like when viewed in the direction of arrow III in FIG. 2.

FIG. 3 is a diagram illustrating the contact member 800, the temperature sensor ST, and the like when viewed in the direction of arrow III in FIG. 2. In the present exemplary embodiment, as denoted by reference numeral 3A, the temperature sensor ST is positioned on the side opposite to the side on which the recording material P is present with the contact member 800 interposed between the temperature sensor ST and the recording material P.

Here, in the case where a reference for transporting the recording material P is a center reference, that is, in the case where the recording material P is moved in such a manner that a center portion of the recording material P in the width direction of the recording material P is moved along a predetermined transport reference, which is set along a recording-material transport path, regardless of the size of the recording material P (regardless of the width of the recording material P), the temperature sensor ST may be disposed at a position that is close to the transport reference or may be disposed on the transport reference.

For example, in the case where reference numeral 3C in FIG. 3 denotes the transport reference, the temperature sensor ST may be disposed at a position that is close to this transport reference or may be disposed on this transport reference.

In this case, even if the size of the recording material P is switched from a large size to a small size, the probability of the temperature sensor ST being positioned in an area located between sides (side edges) PS (left side PSL and right side PSR) of the recording material P increases.

In the case where the temperature sensor ST is disposed at a position spaced apart from the transport reference, when the size of the recording material P is switched from a large size to a small size, it is possible for the temperature sensor ST to be located further on the outside that is, closer to the outside of the image forming apparatus, than the sides PS of the recording material P.

In this case, a decrease in the temperature of a portion of the contact member 800, the temperature of the portion to be detected by the temperature sensor ST, occurs.

As an additional point, in this case, the temperature that is detected by the temperature sensor ST when the size of the recording material P is large and the temperature that is detected by the temperature sensor ST when the size of the recording material P is small are different from each other.

In the case where a reference for transporting the recording material P is a side reference, that is, in the case where the recording material P is moved in such a manner that one of the sides PS of the recording material P in the width direction of the recording material P is moved along a predetermined transport reference (e.g., transport reference denoted by reference numeral 3D), which is set along the recording-material transport path, regardless of the size of the recording material P, the temperature sensor ST may be disposed at a position close to this transport reference, as denoted by reference numeral 3E.

In the case where the temperature sensor ST is disposed on the side (the right end side of the contact member 800 in FIG. 3) opposite to the side on which the transport reference, which is denoted by the reference numeral 3D, is present, when the size of the recording material P is switched from a large size to a small size, a situation where the temperature sensor ST is located further on the outside than one of the side PS (right side PSR) of the recording material P occurs in a similar manner to the above. In this case, a decrease in the temperature of a portion of the contact member 800 that is to be detected by the temperature sensor ST occurs.

Note that it is not intended to preclude the configuration in which the temperature sensor ST is located further on the outside than one of the sides PS of the recording material P, and the temperature sensor ST may be located further on the outside than the side PS (left side PSL) of the recording material P as denoted by reference numeral 3F in FIG. 3 (may be located further on the outside than the transport reference denoted by the reference numeral 3D). In the case where the temperature sensor ST is disposed so as to be located further on the outside than one of the sides PS of the recording material P as described above, the temperature sensor ST may be disposed at, for example, a position denoted by reference numeral 3G.

In the present exemplary embodiment, the contact member 800 is provided in such a manner as to extend in a direction crossing (perpendicular to) the direction of movement of the recording material P, and portions of the contact member 800 (the end portions of the contact member 800 in the axial direction of the contact member 800) are located further on the outside than the sides PS of the recording material P.

The temperature sensor ST denoted by the reference numeral 3F is located further on the outside than the left side PSL of the recording material P (is located further on the outside than the transport reference denoted by the reference numeral 3D) and detects the temperature of a portion of the contact member 800 (left end portion of the contact member 800 in FIG. 3) that is located further on the outside than the left side PSL of the recording material P.

In the present exemplary embodiment, as illustrated in FIG. 3, the diameter of a center portion of the contact member 800 in the axial direction of the contact member 800 is larger than the diameter of each of the end portions of the contact member 800 in the axial direction.

Consequently, the heat of the recording material P is more likely to be transferred to the contact member 800 whereas if the diameter of the center portion of the contact member 800 and the diameter of each of the end portions of the contact member 800 in the axial direction of the contact member 800 are equal to each other, the heat of the recording material P would not be easily transferred to the contact member 800.

In the case where the diameter of the center portion of the contact member 800 and the diameter of each of the end portions of the contact member 800 in the axial direction of the contact member 800 are equal to each other, it is difficult for the heat from the recording material P to be transferred to the contact member 800 at the center portion of the contact member 800 in the axial direction of the contact member 800 due to deflection of the contact member 800.

More specifically, in the present exemplary embodiment, the ends of the contact member 800 are supported, and the center portion of the contact member 800 in the axial direction of the contact member 800 is displaced in a direction away from the recording material P due to deflection of the contact member 800, so that the contact pressure generated by the recording material P and the contact member 800 is likely to decrease at the center portion.

In such a case, when the diameter of the center portion of the contact member 800 in the axial direction of the contact member 800 is larger than the diameter of each of the end portions of the contact member 800 in the axial direction as in the present exemplary embodiment, a decrease in the contact pressure is suppressed, and the heat of the recording material P is likely to be transferred to the contact member 800 at the center portion in the axial direction of the contact member 800.

Figure 4:
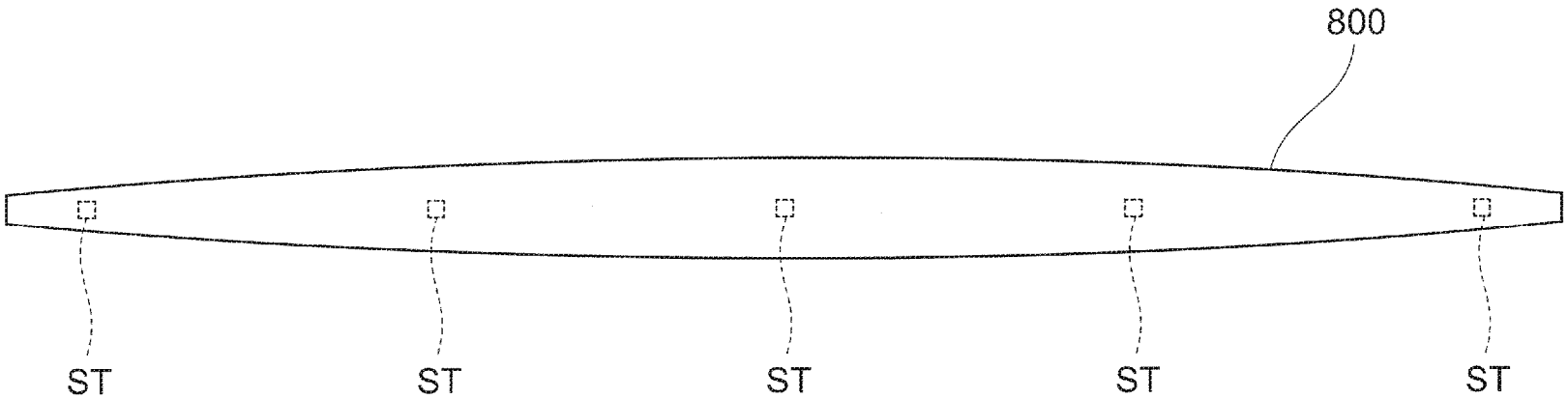
FIG. 4 is a diagram illustrating another example of providing the temperature sensor.

FIG. 4 is a diagram illustrating another example of providing the temperature sensor ST. FIG. 4 illustrates the contact member 800 and temperature sensors ST when viewed in the direction of arrow IV in FIG. 2. Note that the recording material P is not illustrated in FIG. 4.

In another exemplary embodiment illustrated in FIG. 4, the plural temperature sensors ST are provided. In addition, in the present exemplary embodiment, the temperature sensors ST are arranged in such a manner that the positions of the temperature sensors ST (the positions of the temperature sensors ST in the width direction of the recording material P) are different from one another in the axial direction of the contact member 800.

In the present exemplary embodiment, the temperatures of plural portions of the contact member 800 are detected by the temperature sensor ST.

(Others)

The case where an image is formed on the continuous recording material P extending in the transport direction of the recording material P has been described above as an example. However, also in the case where an image is formed on one of transparent recording materials P that are cut one by one, the temperature of the recording material P may be detected while suppressing formation of scratches on the recording material P.

In addition, although a contact temperature sensor that is in contact with the contact member 800 has been described above as an example of the temperature sensor ST, a non-contact temperature sensor may be used.

Although, in the above exemplary embodiments, the heating device 700 is controlled on the basis of detection results obtained by the temperature sensor ST, the fixing device 60 (the heating sources, which are the halogen heater 71, the halogen heater 72, and the halogen heater 73) may be controlled on the basis of the detection results. In addition, both the heating device 700 and the fixing device 60 may be controlled on the basis of the detection results.

Although a member having a roll-like shape or a substantially roll-like shape has been described above as an example of the contact member 800, a member that moves circularly like the transport belt 720 (see FIG. 2) included in the heating device 700 may be used as the contact member 800.

Portions where the heating device 700, the contact member 800, and the temperature sensor ST, are provided may be integrated with one another so as to form a unit in such a manner that the portions where the heating device 700, the contact member 800, and the temperature sensor ST, are provided are removable from an apparatus body of the image forming apparatus 1. Here, the portions where the heating device 700, the contact member 800, and the temperature sensor ST, are provided may be perceived as a heating system.

Similarly, portions where the contact member 800, the temperature sensor ST, and the fixing device 60 are provided may be integrated with one another so as to form a unit in such a manner that the portions where the contact member 800, the temperature sensor ST, and the fixing device 60 are provided are removable from the apparatus body of the image forming apparatus 1. Here, the portions where the contact member 800, the temperature sensor ST, and the fixing device 60 are provided may be perceived as a fixing system.

Figure 5:
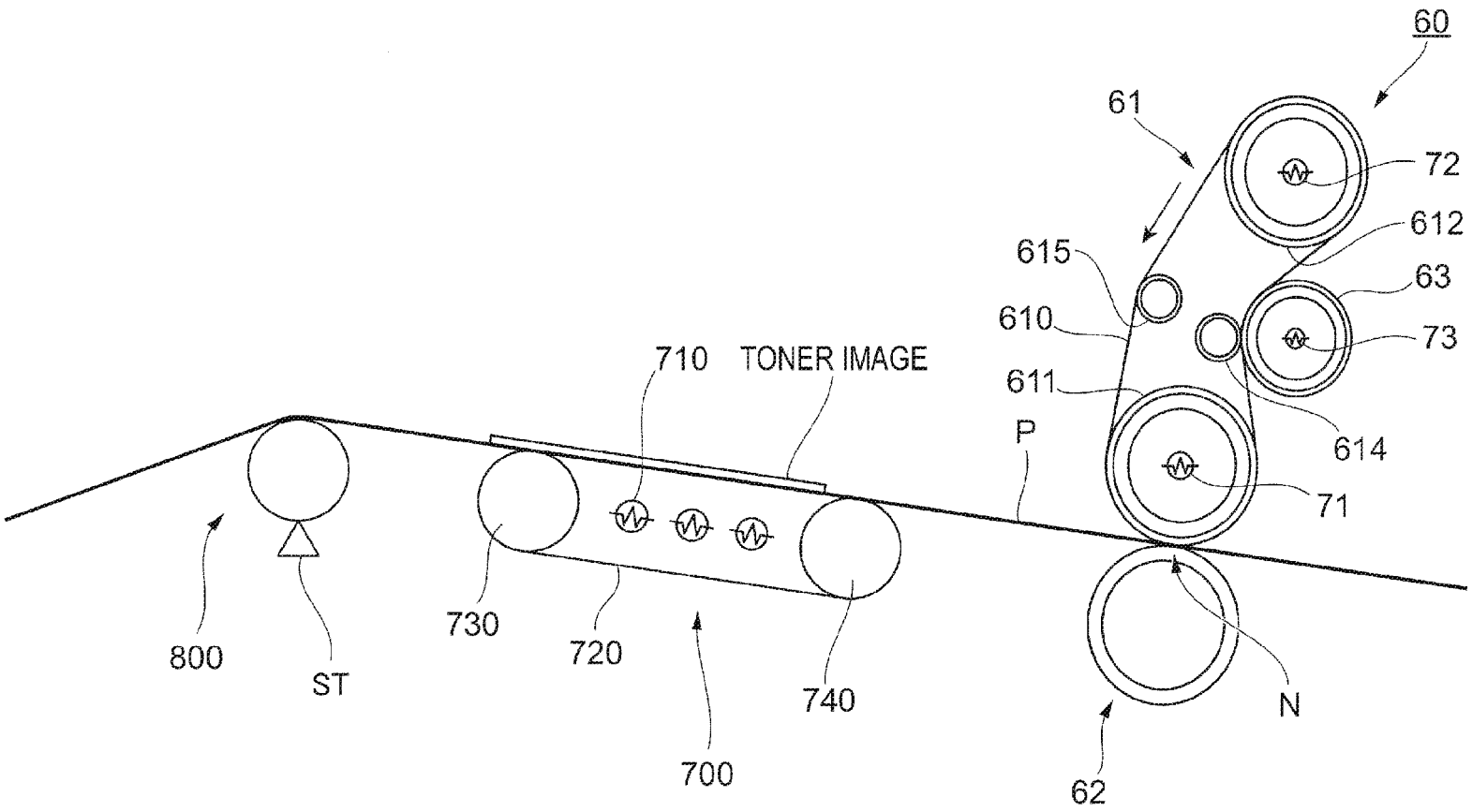
FIG. 5 is a diagram illustrating another arrangement example of the heating device, the contact member, the temperature sensor, and the fixing device.

As illustrated in FIG. 5, which is a diagram illustrating another arrangement example of the heating device 700, the contact member 800, the temperature sensor ST, and the fixing device 60, the contact member 800 and the temperature sensor ST may be disposed further upstream than the heating device 700 and the fixing device 60 in the transport direction of the recording material P. In other words, in the arrangement example illustrated in FIG. 5, the contact member 800 and the temperature sensor ST are disposed at positions upstream from the heating device 700, which is an example of a heating unit, in the transport direction of the recording material P.

Note that the above-described various configurations such as the configuration in which the recording material P is partially wound around the contact member 800 and the configuration in which the diameter of the center portion of the contact member 800 is larger than the diameter of each of the end portions of the contact member 800 in the axial direction of the contact member 800 may be applied to the exemplary embodiment illustrated in FIG. 5.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing system comprising:

a heater configured to heat a recording material;

a contact member that is positioned upstream or downstream from the heater in a transport direction of the recording material and is configured to contact the recording material, wherein a portion of the contact member in contact with the recording material is configured to move with the recording material;

a temperature detector configured to detect a temperature of the contact member;

a controller configured to detect, based on a detection result obtained by the temperature detector, an output of the heater; and a fixing device that is positioned downstream from the heater and the contact member in the transport direction of the recording material, wherein the fixing device is configured to fix an image on the recording material.

2. The fixing system according to claim 1, wherein the contact member is positioned upstream from the heater in the transport direction of the recording material.

3. The fixing system according to claim 1, wherein the contact member is configured to contact the recording material in such a manner that the recording material is partially wound around the contact member, wherein an angle of the transport direction before passing the contact member is different from an angle of the transport direction after passing the contact member.

4. The fixing system according to claim 1, wherein a diameter of a center portion of the contact member, which has a substantially roll-like shape, in an axial direction of the contact member is larger than a diameter of each end portion of the contact member in the axial direction.

5. The fixing system according to claim 1, wherein the contact member is further configured to contact one of two surfaces of the recording material, the surface not having an unfixed toner image formed on the surface.

6. The fixing system according to claim 1, wherein the contact member is formed of a member that has a substantially roll-like shape and that is configured to rotate while being in contact with the recording material.

7. The fixing system according to claim 1, wherein the contact member is configured to extend in a direction crossing a direction of movement of the recording material and a portion of the contact member is configured to extend outside of a side edge of the recording material in a longitudinal direction of the contact member, and wherein the temperature detector is further configured to detect a temperature of the portion of the contact member.

8. The fixing system according to claim 1, wherein the contact member is positioned downstream from the heater in the transport direction of the recording material.

9. The fixing system according to claim 1, wherein the contact member is configured such that heat of the recording material is transferred from the recording material to the contact member.

10. A fixing system, comprising:

a heater configured to heat a recording material;

a contact member that is positioned upstream or downstream from the heater in a transport direction of the recording material and is configured to contact the recording material, wherein a portion of the contact member in contact with the recording material is configured to move with the recording material;

a temperature detector configured to detect a temperature of the contact member;

a controller configured to detect, based on a detection result obtained by the temperature detector, an output of the heater; and a fixing device configured to fix an image on the recording material, wherein the contact member does not have a heating source and is configured such that heat of the recording material is transferred from the recording material to the contact member.

11. The fixing system according to claim 1, wherein the contact member is configured to contact the recording material in such a manner that the recording material is partially wound around the contact member, and the recording material is configured to move at an upward angle before passing the contact member and to move at a downward angle after passing the contact member.

12. The fixing system according to claim 1, wherein the contact member is configured to contact the recording material in such a manner that the recording material is partially wound around the contact member, and the recording material is configured to move at a downward angle before passing the contact member and to move at an upward angle after passing the contact member.

* * * * *